US009453324B2

(12) United States Patent
Van Opstal

(10) Patent No.: US 9,453,324 B2
(45) Date of Patent: Sep. 27, 2016

(54) CUTTER HEAD FOR REMOVING MATERIAL FROM A WATER BED

(71) Applicant: IHC HOLLAND IE B.V., Sliedrecht (NL)

(72) Inventor: Timothy Alexander Van Opstal, Rotterdam (NL)

(73) Assignee: IHC HOLLAND IE B.V, Sliedrecht (NL)

( * ) Notice: Subject to any disclaimer, the term of this patent is extended or adjusted under 35 U.S.C. 154(b) by 93 days.

(21) Appl. No.: 14/412,462

(22) PCT Filed: Jul. 5, 2013

(86) PCT No.: PCT/NL2013/050504
§ 371 (c)(1),
(2) Date: Jan. 2, 2015

(87) PCT Pub. No.: WO2014/007634
PCT Pub. Date: Jan. 9, 2014

(65) Prior Publication Data

US 2015/0275473 A1 Oct. 1, 2015

(30) Foreign Application Priority Data

Jul. 6, 2012 (NL) ..... 2009146

(51) Int. Cl.
*E02F 3/92* (2006.01)
*E02F 9/28* (2006.01)
(Continued)

(52) U.S. Cl.
CPC ..... *E02F 3/9212* (2013.01); *E02F 3/9231* (2013.01); *E02F 5/282* (2013.01); *E02F 9/2866* (2013.01); *E21B 10/43* (2013.01)

(58) Field of Classification Search
CPC ... E02F 3/9212; E02F 3/9225; E02F 3/9231; E02F 9/2866; E02F 5/282; E21B 10/43
See application file for complete search history.

(56) References Cited

U.S. PATENT DOCUMENTS 727,691 A 5/1903 Robinson
797,109 A * 8/1905 Harris ..... E02F 3/9225 37/328

(Continued)

FOREIGN PATENT DOCUMENTS

DE 102004033934 A1 * 2/2006 ..... E02F 3/241
EP 0376433 A1 7/1990

(Continued)

OTHER PUBLICATIONS

International Search Report, dated Sep. 27, 2013, from corresponding PCT application.

*Primary Examiner* — Jamie L McGowan
(74) *Attorney, Agent, or Firm* — NLO N.V.; Catherine A. Shultz; Minerva Rivero

(57) ABSTRACT

A cutter head (1) for removing material from a water bed. The cutter head (1) is arranged to rotate about an axis of rotation (RA). The cutter head (1) includes a base ring (10) and a hub (20), the base ring (10) and the hub (20) being positioned rotational symmetric with respect to the axis of rotation (RA). The cutter head (1) includes a plurality of arms (30) extending between the base ring (10) and the hub (20), the arms (30) including a plurality of excavating tools (40). The excavating tools are provided by bits (40) having rotational symmetric bit ends (41), wherein the arms (30) include one or more groups of bits (40), each group including three or more adjacent bits (40) of which the bit ends (41) define a straight line segment (LS).

15 Claims, 8 Drawing Sheets

(51) Int. Cl.
*E21B 10/43* (2006.01)
*E02F 5/28* (2006.01)

(56) References Cited

U.S. PATENT DOCUMENTS

| | | | | | |
|---|---|---|---|---|---|
| 856,487 | A * | 6/1907 | Ollrich | E02F 3/9225 | 37/328 |
| 856,544 | A * | 6/1907 | Ollrich | E02F 3/9225 | 37/328 |
| 1,316,349 | A * | 9/1919 | Calder | E02F 3/9225 | 37/328 |
| 2,233,943 | A * | 3/1941 | Gaylord | E02F 3/9225 | 37/328 |
| 2,370,430 | A * | 2/1945 | Waldeck | E02F 3/9231 | 37/331 |
| 3,760,518 | A * | 9/1973 | Hamm | E02F 3/9231 | 37/189 |
| 3,808,716 | A * | 5/1974 | Verbeek | E02F 3/9225 | 37/328 |
| 3,885,330 | A | 5/1975 | Araoka | | |
| 4,373,277 | A * | 2/1983 | Cucheran | E02F 3/9293 | 37/327 |
| 4,403,428 | A * | 9/1983 | Chapman, Jr. | E02F 3/94 | 241/195 |
| 4,682,663 | A * | 7/1987 | Daly | E21B 10/43 | 175/431 |
| 4,711,504 | A * | 12/1987 | Berchem | E21C 35/197 | 299/106 |
| 4,891,893 | A * | 1/1990 | Bowes, Jr. | E02F 9/2808 | 299/109 |
| 5,617,654 | A * | 4/1997 | Wetta, II | E02F 3/9212 | 37/321 |
| 6,578,294 | B2 * | 6/2003 | Ollinger, IV | E02F 3/9231 | 299/87.1 |
| 7,739,812 | B2 * | 6/2010 | Wijma | E02F 3/9212 | 299/87.1 |
| 8,732,991 | B2 * | 5/2014 | Claessens | E02F 3/9231 | 37/327 |
| RE45,648 | E * | 8/2015 | Ollinger, IV | | |

FOREIGN PATENT DOCUMENTS

| | | | | | |
|---|---|---|---|---|---|
| JP | 50038142 | U | 4/1975 | | |
| WO | 2011003869 | A1 | 1/2011 | | |
| WO | 2011162987 | A2 | 12/2011 | | |
| WO | WO 2015160255 | A1 * | 10/2015 | E02F 3/8841 | |

* cited by examiner

CUTTER HEAD FOR REMOVING MATERIAL FROM A WATER BED

TECHNICAL FIELD

The invention relates to a cutter head for removing material from a water bed, the cutter head being arranged to rotate about an axis of rotation, the cutter head comprising a base ring and a hub, the base ring and the hub being positioned rotational symmetric with respect to the axis of rotation, the cutter head comprising a plurality of arms extending between the base ring and the hub, the arms comprising a plurality of excavating tools. The invention further relates to a vessel comprising such a cutter head.

BACKGROUND

Cutter-suction dredgers (CSD) are known. Such dredgers use a suction tube which has a cutter head at the suction inlet. The cutter head may be connected to the dredger with a hub that is mounted on an axis with a drive to rotate the cutter head. The axis of rotation is referred to as the axial direction of the cutter head. The material cut by the cutter is sucked into the suction tube and transported away from the cutter head, for instance via a floating pipe line to a dumping location.

The cutter head cuts and loosens the bed material such that it can be sucked into the suction tube. The cutter head and suction inlet may be moveable with respect to the water bed.

In order to suck the bed material into the suction tube a wear-resistant pump may be provided, such as a centrifugal pump.

Cutter-suction dredgers are often used to cut hard surface materials, such as rock, although they may also be used to excavate gravel or sand.

The cutter head may be provided with a plurality of excavating tools, such as teeth, formed as chisels, to chisel the bed material. The excavating tools may also be formed by a cutting edge comprising a plurality of teeth. However, the excavating tools are prone to wear, especially when hard surface materials are cut.

Therefore, cutter heads are known which comprise replaceable teeth or replaceable cutting edges. Replacing teeth is a time and therefore money consuming operation and contributes to the down-time of the cutter-suction dredger.

Known cutter head designs comprise a base ring provided around the suction opening to which a plurality of arms are connected. The arms extend in an axial direction away from the suction opening and converge towards each other radially thereby forming the cutter head in front of the suction opening. The arms may be curved in a tangential and radial direction such that the arms spiral towards each other. The arms may also be curved in the radial direction only, while being axially aligned or at a small angle with respect to the axial direction. Such a design is for instance known as the Lancelot (manufactured by IHC Parts & Services).

The converging arms may approach each other in the middle at a distance in front of the suction opening where they are connected to the hub which drives the cutter head.

The excavating tools, such as teeth or cutting edges are attached to the arms. The bed material is loosened and cut by the excavating tools and is sucked into the suction opening through the space in between the arms. The teeth also functions as scoops, which scoop the cut and/or loosened material from the water bed, scooping it towards the suction opening.

Known cutter heads have a number of disadvantages.

For instance, the teeth, formed as chisels, are prone to wear and need to be replaced often, increasing the downtime of the cutter head. In some situations, the teeth do not last more than an hour.

U.S. Pat. No. 3,885,330 and EP-A1-0376433 show an apparatus for digging a hole and a cutting tool which are not suitable for use in combination with cutter-suction dredgers. These documents show tools with arms comprising a plurality of excavating tools positioned in a plane perpendicular to an axis of rotation of the tool. Such tools will therefore not be suitable to function when positioned at an angle other than perpendicular with respect to the water bed. Also, such cutting tools are not suitable for being moved in a direction perpendicular to their rotational axis, as is common in cutter-suction dredgers, wherein the cutter-suction dredgers are provided with spud systems which allow the cutter-suction dredger to perform a rotating movement with respect to a spud, thereby moving the cutter head along the water bed.

WO2011003869 discloses such a cutter head for dredging ground under water. This cutter head is suitable for attachment rotatably around a central axis to the ladder of a cutter suction dredger and for being moved through the ground therewith in a lateral sweeping movement. The cutter head comprises a base ring, a hub situated at a distance in the direction of the central axis from the base ring, and a plurality of support arms extending from the base ring to the hub, wherein a passage opening is located between support arms and wherein the cutting tools are axisymmetrical, at least at their free outer end. The cutting tools are axisymmetrical at least at their free outer end, and preferably along their entire length, thereby allowing free rotation around their longitudinal axis. The cutting tools may be rotation-symmetrical and preferably of conical form. Such cutting tools take up less space making it possible to provide the cutter head with a large number of cutting tools. The cutting tools may be arranged in a socket such that it can be rotated freely or at least readily around its axis of rotation-symmetry. Allowing free or ready rotation of the tools during operation reduces the risk for breakage and also self-sharpens the soil-contacting tip of the cutting tools by friction with the soil.

In a preferred embodiment the cutter head according to the invention comprises at least 50 cutting tools, more preferably at least 100 cutting tools, still more preferably at least 140 cutting tools, and most preferably at least 180 cutting tools. The cutting tools can here be distributed regularly, but also irregularly, over the revolving surface of the cutter head. The number of cutting tools per support arm preferably comprises at least 10 cutting tools, more preferably at least 15 cutting tools, still more preferably at least 20 cutting tools, and most preferably at least 25 cutting tools.

However, in the prior art there is a prejudice against the use of such cutting tools which are axisymmetrical at least at their free outer end. Reference is also made to WEAR RESISTANT DREDGE CUTTER TEETH A LOOK AT THE DEVELOPMENT OF THE TOOTH AND ITS IMPACT ON THE ECONOMICAL AND ENVIRONMENTAL ASPECTS OF THE DREDGER LOGISTICS AND FOUNDRY, by Klaas Wijma, in Proceedings of the CEDA dredging days 2009, Dredging tools for the future, Rotterdam (www.dredging.org). According to this article, tests have been done with bits on conventional dredge cutter heads without success. A number of reasons for the lack of success are identified by Wijma. In the first place, the useful length of the hard metal rod in the conical bit is relatively short, resulting in a short life time. Secondly, the conical bits are designed for small cutting depths, resulting in a low production. Thirdly, the strength of the bits is relatively small, approximately 150 kN, where teeth can withstand cutting forces or normal forces in the range of 1500-2000 kN. All these disadvantages result in fast wear of the bits and the adapter (holding the bit), higher torque and penetration forces and increased breakages.

JP-U-50038142 shows the use of non rotational symmetric bit ends. The device according to this document has the disadvantage that it will not be effective in cutting material at the distal end of the cutter head, as no excavating tools are present there.

SUMMARY

It is an object to provide a more effective cutter head.

According to an aspect there is provided a cutter head for removing material from a water bed, the cutter head being arranged to rotate about an axis of rotation, the cutter head comprising a base ring and a hub, the base ring and the hub being positioned rotational symmetric with respect to the axis of rotation, the cutter head comprising a plurality of arms extending between the base ring and the hub, the arms comprising a plurality of excavating tools, wherein the excavating tools are provided by bits having rotational symmetric bit ends, wherein the arms comprise one or more groups of bits, each group comprising three or more adjacent bits of which the bit ends define a straight line segment.

In particular, the arms comprise two or more groups of bits, each group comprising three or more adjacent bits of which the bit ends define a straight line segment.

Such a group of adjacent bits forms a rake, the bits being mounted to a shared base and being substantially parallel. Preferably five or more adjacent bits define a straight line.

This has been found to result in a very effective and efficient cutter head, especially in combination with the use of bits. As the bit ends are positioned in such a way, the arms can be constructed in a relatively easy way, without the need of a helical or double-bent shape. Also, because the bits lie on straight line segment, the bit ends can be positioned relatively close to each other, contributing to the scooping or raking.

Furthermore, fluctuations in cutter power are reduced and the motion of the cutter head is more smoothly, resulting in smaller forces and vibrations acting on the cutter head, the ladder, the vessel and possibly the spuds. The lifetime of these components is thus increased. Also, the working conditions for staff on board the vessel are improved as the vessel will be less subjected to vibrations.

According to an embodiment the base ring and the hub are axially displaced with respect to each other along the axis of rotation, the hub being positioned closer to a distal end of the cutter head with respect to the base ring, wherein the arms comprise two or more groups of bits, the bit ends thereof defining straight line segments, wherein angles between the respective straight line segments and the axis of rotation increase towards the distal end of the cutter head.

The distal end of the cutter head (which may also be referred to as the free end) is the end of the cutter head which is in use directed towards the material to be cut. Towards the distal end, the straight line segments become more and more angled with respect to the axis of rotation. Thereby a ball-shaped cutter head or quasi spherical cutter head is created which is formed by bit ends which are positioned along straight line segments. Such a cutter head has cutting capabilities in the radial as well as the axial direction.

Such a cutter head is in particular suitable to be used for dredging wherein the axis of rotation is orientated diagonally with respect to the water bed as is typical in use with cutter-suction dredgers, wherein the cutter head is mounted on a ladder. Also, such a cutter head is in particular suitable to function while being moved in a direction perpendicular to the axis of rotation of the cutter head, the cutter head moving along the water bed as a result of a spud-guided movement of the cutter-suction dredger the cutter head is attached to. As a result of the configuration of the arms and the groups of bits, the cutter head is able to cut in a direction perpendicular to the axis of rotation and in a sideward direction.

According to an embodiment the one or more line segments associated with an arm defines a bit plane.

Preferably, for each arm, such a bit plane can be defined.

It will be understood that in practice the bit ends may not exactly lie on a straight line segment or bit plane, but that the terms straight line segment and bit plane relate to lines and planes within the tolerances common for cutter heads, especially taking into account that during use the bit ends may wear off.

In case of a single line segment per arm, many bit planes can be defined. In case of two more line segments per arm, the bit plane is uniquely defined.

The base ring and the hub are axially displaced with respect to each other along the rotational axis. The base ring can be connected to a suction tube, such that the arms form the cutter head in front of the suction inlet of the suction tube. The hub is arranged to be connected to and driven by a drive axis, to rotate the cutter head about the rotational axis. The drive axis may be part of a ladder.

The bits may comprise a bit head made of Tungsten-carbide as this is an advantageous material to provide a strong bit head.

According to an embodiment the one or more line segments associated with an arm together form a straight bit line when projected on a projection plane perpendicular to the rotational axis (RA).

According to an embodiment the bit line is offset with respect to the rotational axis.

In the projection to the projection plane perpendicular to the rotational axis, the bit lines may have a closest distance d to the rotational axis, wherein d is in the range $0.05R<d<0.2R$, wherein R is the radius of the base ring.

By providing such an offset it is ensured that the bit ends are not radially aligned in which case the bit ends would hit the water bed at substantially the same time during rotation of the cutter head.

Such an offset has the advantage that, when rotated, the bit ends hit the water bed more or less at successive moments in time, resulting in a cutting force that is evenly distributed over time thereby preventing peak forces. The bit ends will hit the water bed relatively short after each other, contrary to helical arms. This also contributes to an effective cutting process.

According to an embodiment the bit line crosses the rotational axis. Taking into account the tolerances which are acceptable in this field, the bit line has a closest distance d to the rotational axis, wherein d is in the range $0<d<0.05R$, wherein R is the radius of the base ring.

According to this embodiment, the bit line crosses the rotational axis at least in the projection to a plane perpendicular to the rotational axis (RA). Such an embodiment results in a cutter head that is easy to manufacture and provides enough room to place as many arms as possible. Straight arms need less room (surface and volume wise) then helical or double bent arms.

According to an embodiment the base ring has a first diameter and the hub has a second diameter, the first diameter being larger than the second diameter, and the arms converge towards the rotational axis in a direction from the base ring to the hub.

According to an embodiment the line segments are angled with respect to each other in a direction towards the rotational axis in a direction from the base ring to the hub. This provides a ball-shaped cutter head which has cutting capabilities in the radial as well as the axial direction.

Alternatively, the bit line may be bent, i.e. formed by a plurality of straight line segments which are at an angle with respect to each other. Such an embodiment allows easy manufacture of the cutter head, as the arms or at least the bit holders, may be formed by two or more straight parts, which facilitates manufacturing and results in a strong cutter head.

According to an embodiment the bit plane is parallel to and offset with respect to the rotational axis (RA). This embodiment is explained in more detail below with reference to FIG. 3. This has been found to be an advantageous embodiment.

According to an embodiment the bit plane and the rotational axis cross at an angle $\alpha$, wherein $-5° < \alpha < 20°$, preferably $5° < \alpha < 15°$. This embodiment is explained in more detail below with reference to FIGS. 6*a-b*.

According to an embodiment the arms comprise straight elongated bit holders, each bit holder being arranged to hold a plurality of bits.

The bit holder may be replaceable, facilitating fast and efficient change of bits by replacing a bit holder with a new bit holder comprising new bits. Also, by using straight bit holders, the bits can be positioned relatively close to each other compared to curved arms.

Alternatively, the bits may be formed integrally with the arms of the cutter head or connect them to the arms directly, for instance by welding or via coupling means.

According to an embodiment the cutter head comprises a plurality of sub-arms and an intermediate ring positioned in between the base ring and the hub, the sub-arms comprising a plurality of excavating tools, and wherein the sub-arms extend between the base ring and the intermediate ring and are shorter than the arms extending between the base ring and the hub. The excavating tools provided on the sub-arms may also be formed by bits having rotational symmetric bit ends. The intermediate ring is in the axial direction positioned in between the base ring and the hub and has an outer diameter smaller than the base ring and larger than the hub. The arms may be formed by one or more arm segments. For instance, the arms extending from the base ring to the hub may be formed by two arm segments, one extending from the base ring to the intermediate ring and one from the intermediate ring to the hub.

Such a cutter head overcomes the disadvantage caused by the size of the outer diameter of the hub forming a restriction on the amount of arms that can be provided. A relatively small hub, with a small outer diameter, allows to provide converging arms forming a more or less ball shaped cutter head. This is advantageous as such a cutter head can be used in a wide range of angles with respect to the water bed. It can be productive when being moved through the water bed in a radial direction (sideways direction) and also when being pushed into the water bed in the axial direction, as it has teeth projecting in a radial direction as well as in the axial direction. However, a small hub can only support a few arms (e.g. 5 or 6 arms).

A larger hub or a hub to which an additional ring is connected to create a larger outer diameter, can support more arms (e.g. 8 or 10 arms), but can only be used in a smaller range of angles. Such a cutter head will have a barrel shape (like the Lancelot cutter head from IHC Parts & Services), more than a ball shape. The arms of such a cutter head will be less converging and will be less effective when the cutter head is pushed into the water bed in the axial direction.

U.S. Pat. No. 727,691 describes a cutter device for dredges, comprising a shaft, a hub attached thereto, a series of blades connected with said hub, an annular part extending around the shaft but free therefrom and joining the ends of said blades, a second series of blades connected to said annular part, and means for supporting the ends of said latter blades.

A cutter head with bits and a combination of main and sub-arms has been found to be very efficient, resulting in a higher production.

According to an embodiment the plurality of arms comprise at least 8 bits per meter, preferably at least 10 bits per meter or more preferably at least 12 or 15 bits per meter.

In other words, the bits are positioned relatively close to each other. By positioning the bits relatively close to each other, a cutter head is provided which is unexpectedly efficient and wear-resistant, contrary to the negative indications provided by the prior art about the use of bits.

By providing a relatively large amount of bits and by putting them on a straight lines, the cutting forces will be distributed over the different bits which ensures that the bits will not wear off too quickly.

Also, the relative high density of bits and arms will contribute to the scooping effect, ensuring that the cut and/or loosened material is scooped to the inside of the cutter head where it can be collected via a suction opening of a suction tube. As the bits are positioned relatively close to each other, the cut and loosened material is raked up in an efficient way, reducing spillage. Also, as the bits are relatively close to each other, the soil is cut in relatively small fragments, which reduces the risk of blockage.

According to an embodiment there is provided a cutter head wherein the arms comprise fifteen bits or more.

Alternatively, there is provided a cutter head wherein the distance between neighbouring bits is smaller than a length of a protruding part of the bits.

According to an embodiment the bits are rotatable about their body axes.

By mounting the bits in a rotational manner, allowing the bits to rotate about their respective body axes, the bits are self-sharpening, which lengthens the life-time of the drill bits and thereby reduces the down-time.

According to a further aspect there is provided a vessel comprising a cutter head according to any one of the preceding claims.

According to an embodiment the vessel is a cutter-suction dredger.

BRIEF DESCRIPTION OF THE DRAWINGS

Embodiments will now be described, by way of example only, with reference to the accompanying schematic drawings in which corresponding reference symbols indicate corresponding parts, and in which.

The figures are meant for illustrative purposes only, and shall not serve as restriction of the scope or the protection as laid down by the claims.

DETAILED DESCRIPTION

With reference to the figures, embodiments will now be described in more detail.

Figure 1:
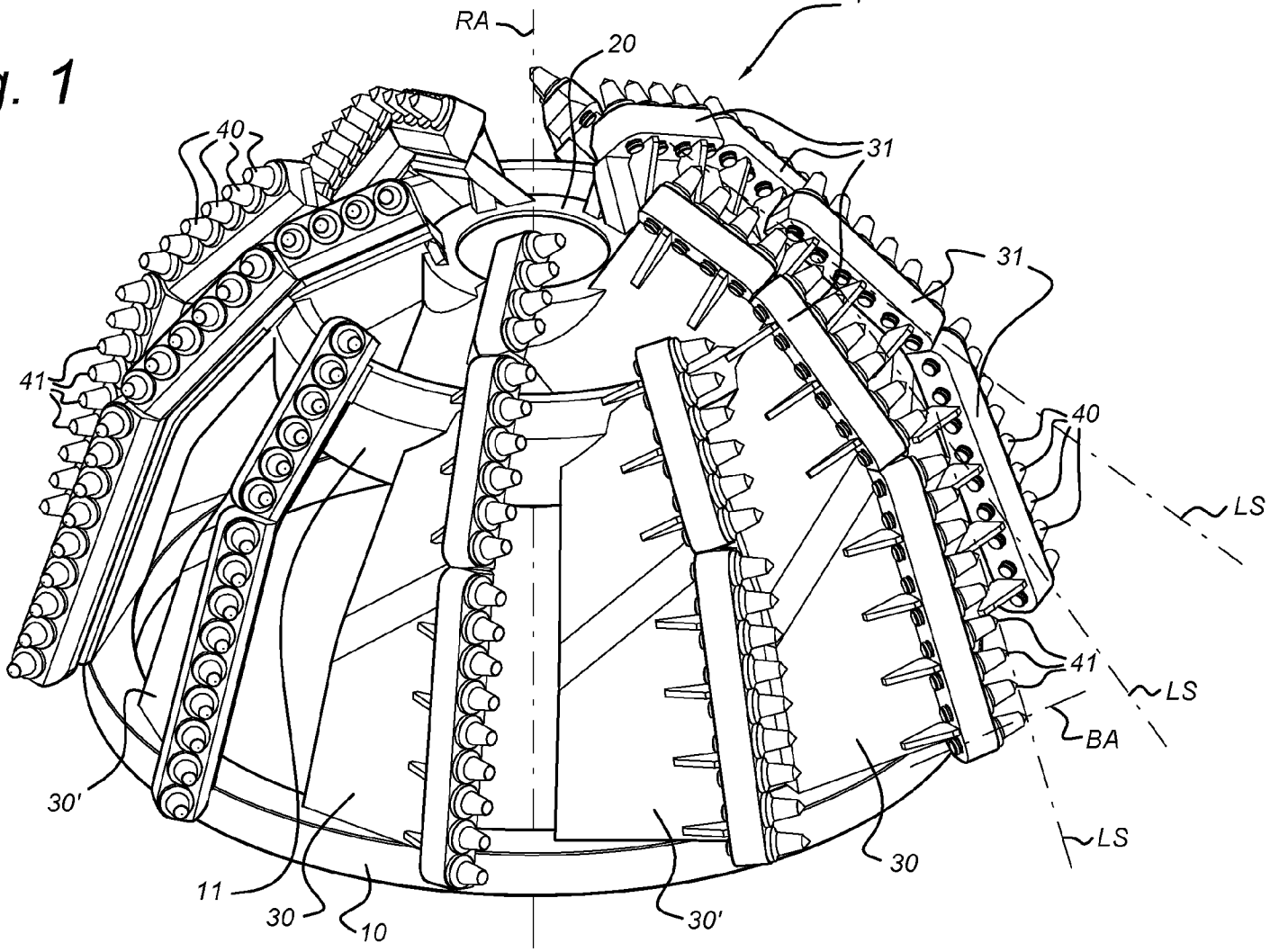
FIG. 1 schematically shows a perspective view of a cutter head according to an embodiment, FIG. 2 schematically shows a side view of a cutter head according to an embodiment, FIGS. 3*a* and 3*b* schematically show an axial view of a cutter head according to two embodiments, FIG. 4 schematically shows a detail of a cutter head according to an embodiment, FIG. 5 schematically shows a perspective view of a cutter head according to an alternative embodiment, FIGS. 6*a*-*b* schematically shows a perspective view of a cutter head according to a further embodiment, and FIG. 7 schematically depicts a vessel comprising a cutter head.
Figure 2:
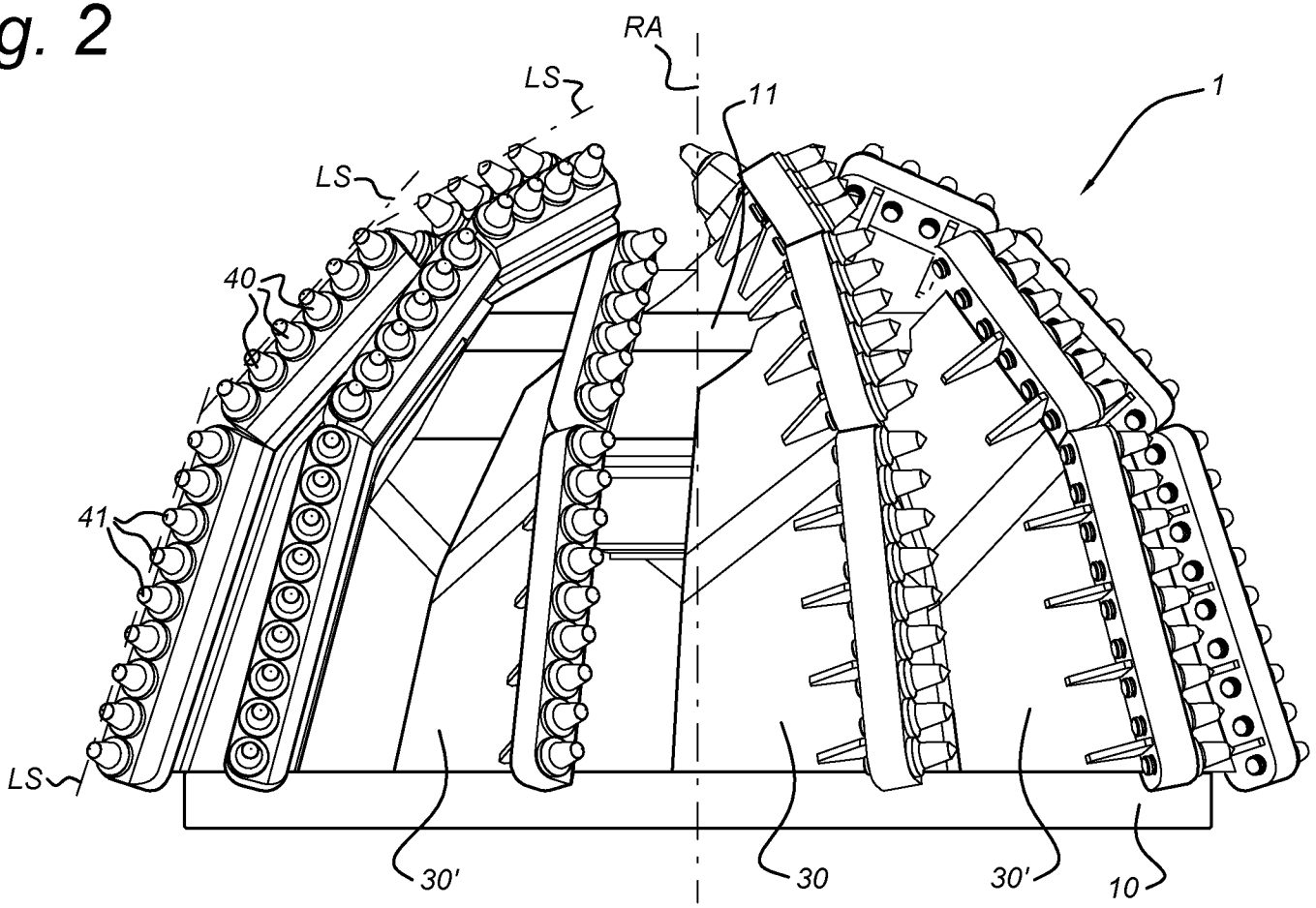

FIGS. 1 and 2 show a cutter head 1. In use the cutter head 1 will be rotated about an axis of rotation RA, for instance by a drive shaft (not shown). The cutter head comprises a base ring 10 and a hub 20, axially displaced with respect to each other. The cutter head 1 comprises a plurality of arms 30 mounted to the base ring 10 and the hub 20. The base ring 10 has a diameter D1 which is larger than a diameter of the hub D2 (see e.g. FIG. 3*a*).

The arms comprise a number of excavating tools, formed by bits 40. The bits 40 have a body axis BA and bit ends 41 being rotationally symmetric with respect to the body axis. The bits 40 may be freely rotatable such that the bits rotate under the influence of cutting forces. This provides a shelf-sharpening effect of the bits 40.

The bits 40 are grouped in groups comprising three or more bits, the bit ends 41 within a group being on a straight line segment LS. This way, the bits 40 form rakes which cut and rake the material in an efficient way. Within a rake, the bits 40 are positioned relatively close to each other, preferable with a density of at least 8, 10, 12 or 15 bits per meter.

An arm 30 may comprise one or more line segments LS. In case two or more line segments LS are comprised, the line segments LS define a bit plane, as is the case in the embodiments shown.

Figure 3A:
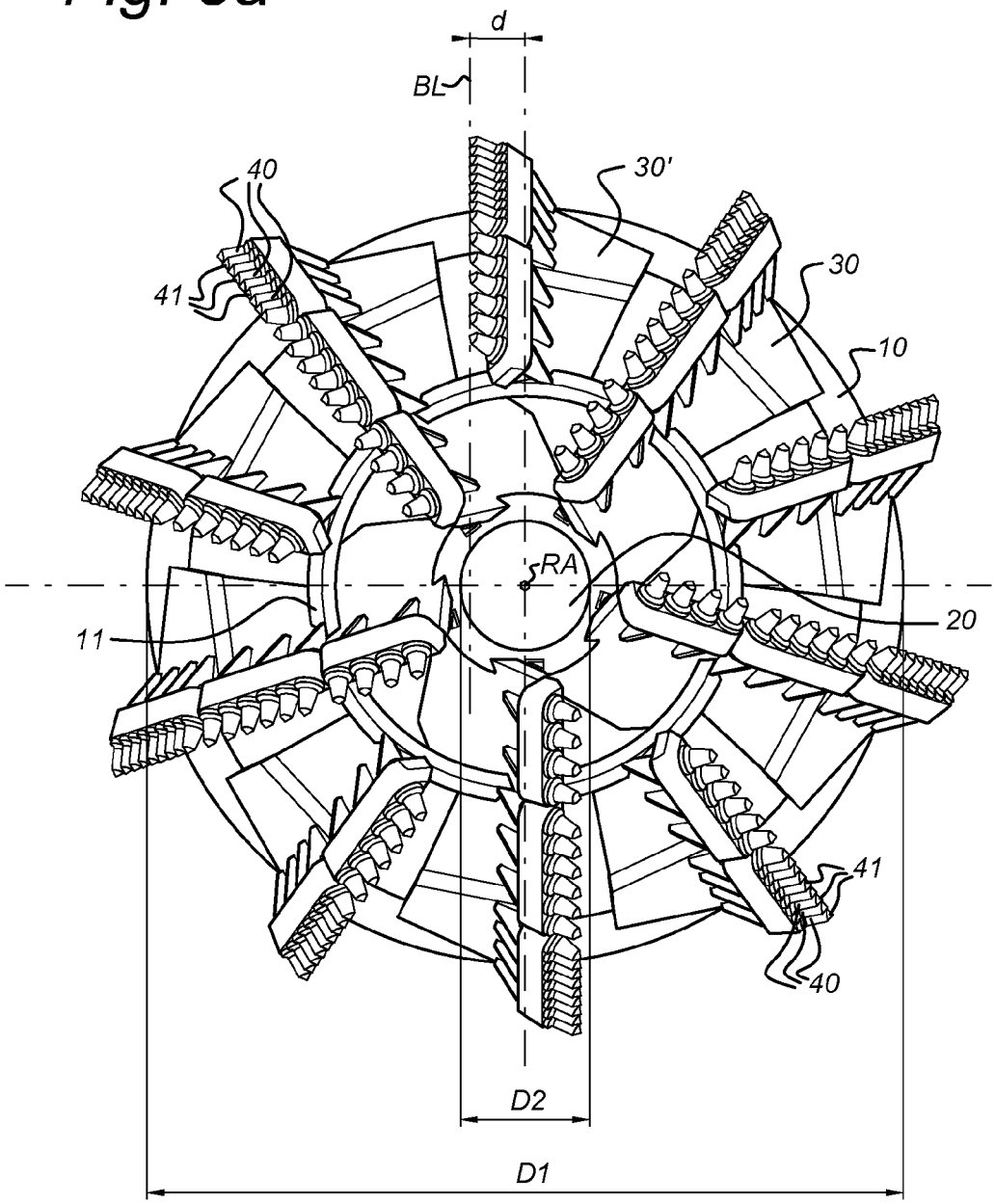
Figure 3B:
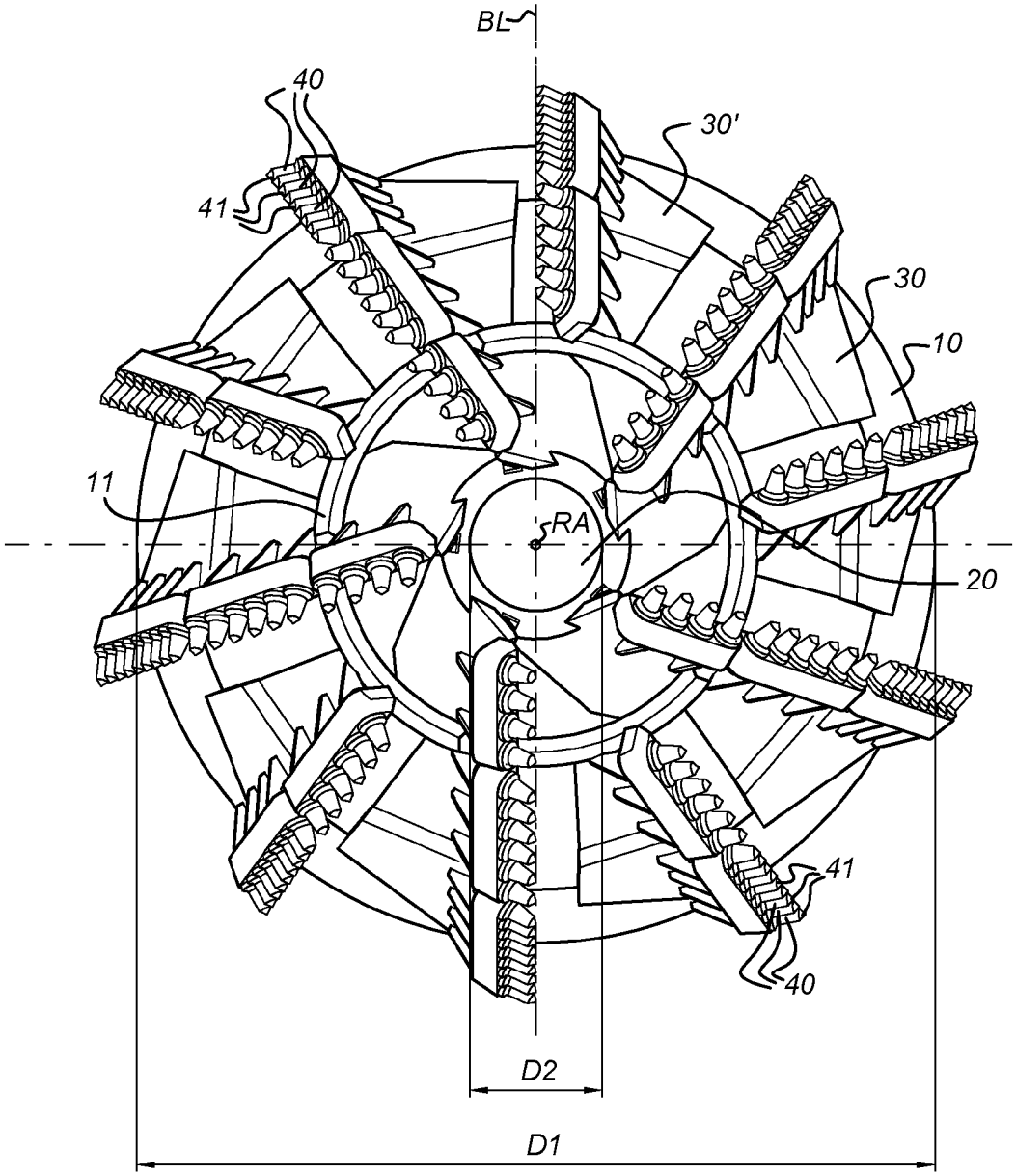

FIGS. 3*a* and 3*b* schematically depict alternative embodiments. According to both embodiments, the one or more line segments LS associated with an arm 30 together form a straight bit line BL when projected on a projection plane perpendicular to the rotational axis RA. As shown in FIG. 3*a*, the bit lines BL pass the rotational axis at a smallest distance d. As shown in FIG. 3*b*, the bit lines BL go through the rotational axis. According to FIG. 3*b*, the distance $d=0$, or in practice $d\approx 0$. In general, the bit lines BL have a closest distance to the rotational axis R of d, wherein $0<d<0.2R$, wherein R is the radius of the base ring 10 ($R=0.5*D1$).

Figure 4:
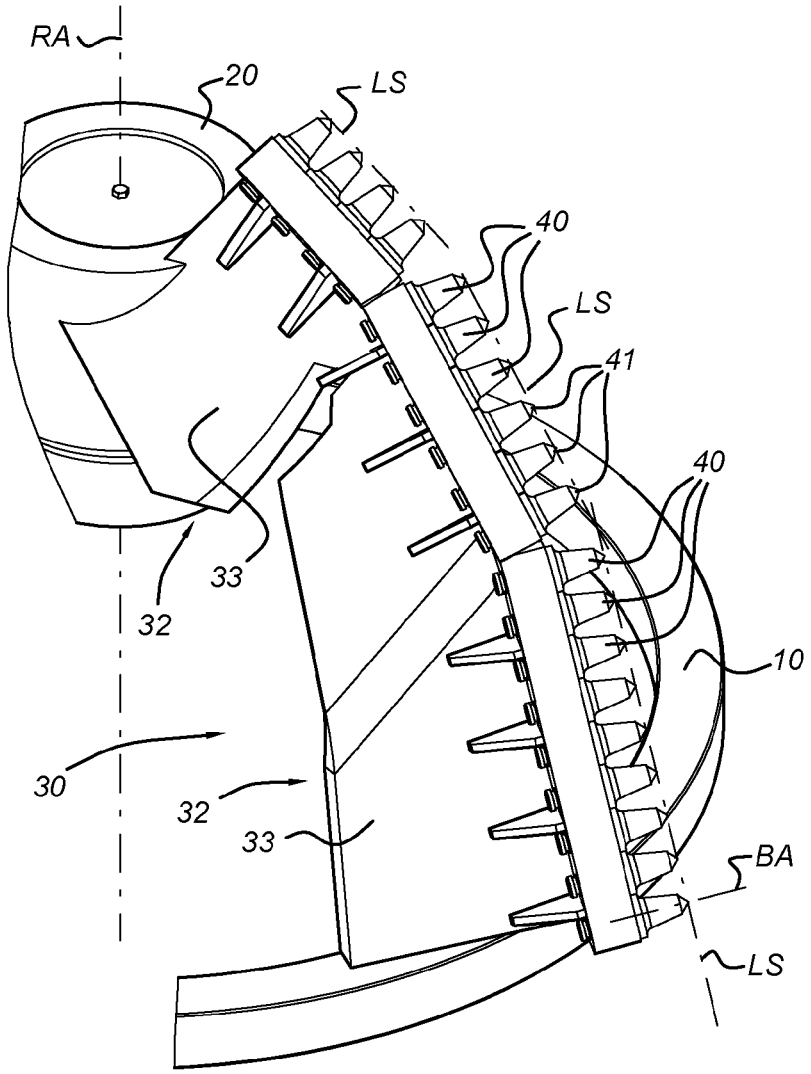

FIG. 4 schematically depicts a part of a cutter head 1, showing a single arm 30. It is noted that the arms 30 may be formed by two or more arm segments 32. The arms 30 may comprise guiding plates 33 to guide the material inwardly, for instance towards a suction tube (not shown in FIG. 4). The arms 30 further comprise three straight elongated bit holders 31, each bit holder holding a plurality of bits 40. FIG. 4 also shows that the line segments LS are angled with respect to each other in a direction towards the rotational axis RA such that the arms 30 provide a convex cutter head 1.

Figure 5:
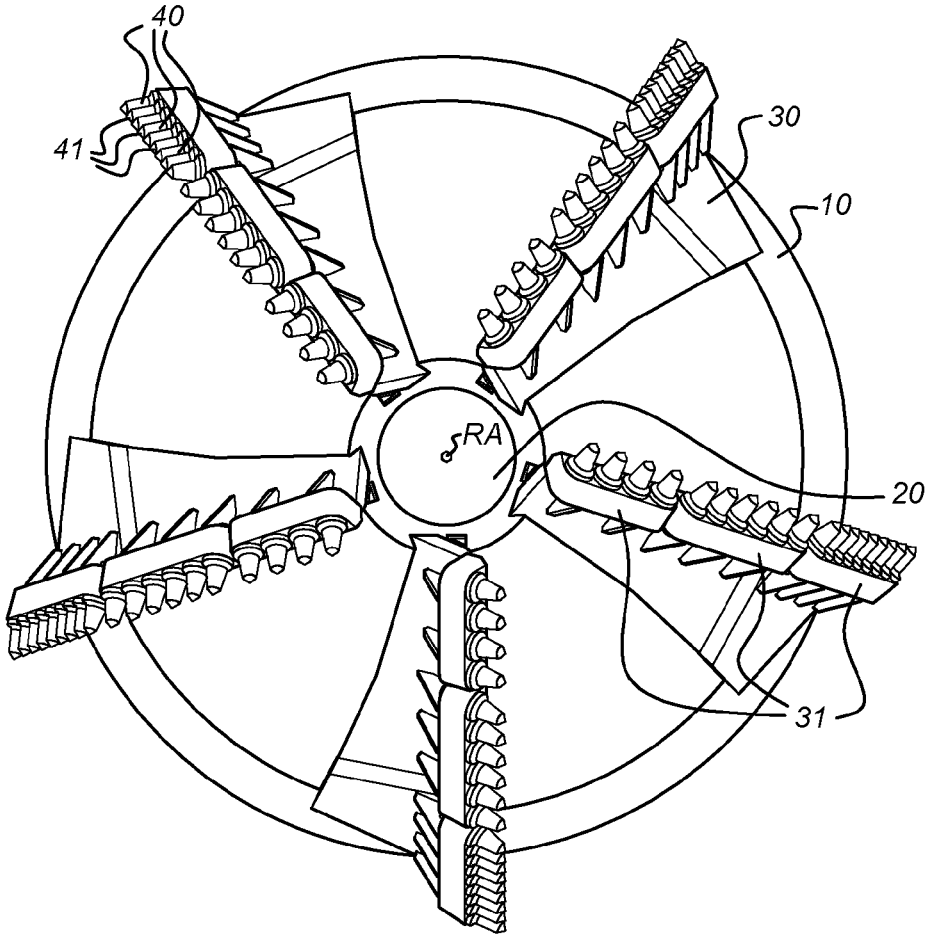

The embodiments shown in FIGS. 1-3*b* show a cutter head 1 which comprises longer arms 30 and shorter arms or sub-arms 30'. An intermediate ring 11 may be positioned in between the base ring 10 and the hub 20, although this intermediate ring 11 may be omitted. FIG. 5 schematically depicts an embodiment without the shorter arms 30'.

Figure 6A:
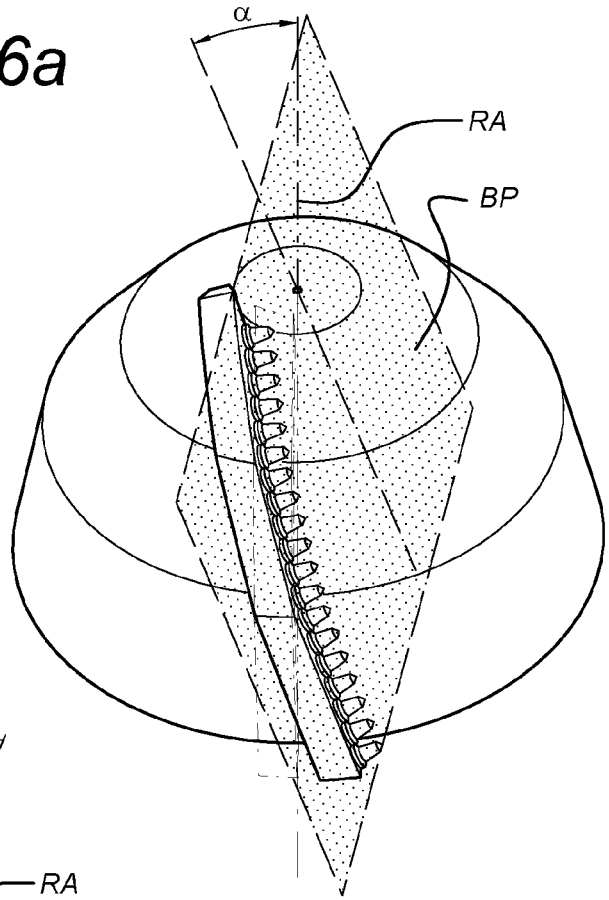
Figure 6B:
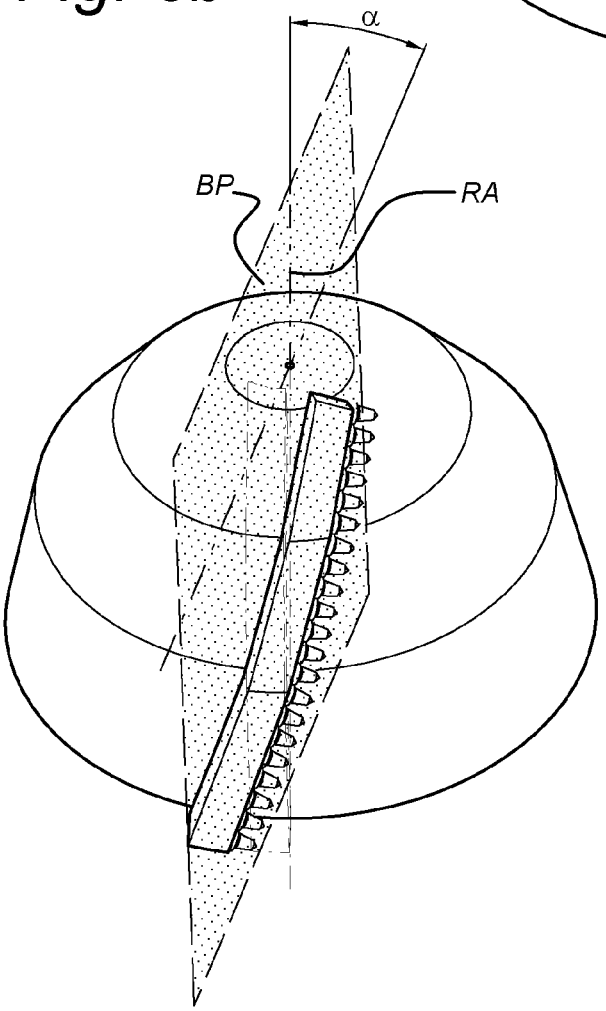

As described above, a bit plane BP may be defined per arm 30, comprising the line segments LS. In case two or more line segments LS are comprised, the bit plane BP is defined uniquely. The bit plane BP may be parallel to the rotational axis RA and comprise the rotational axis RA or may be off-set with respect to the rotational axis RA. Alternatively, as shown in FIGS. 6*a*-6*b*, the bit plane BP and the rotational axis RA may be at an angle $\alpha$, wherein $0°<\alpha<20°$, preferably $5°<\alpha<15°$. The angle $\alpha$ between the bit plane and the rotational axis RA can be defined as $90°-\beta$, wherein $\beta$ is the angle between the rotational axis RA and the normal to the bit plane BP which goes through the intersection between the bit plane BP and the rotational axis RA.

FIGS. 6*a* and 6*b* schematically depict two embodiments, wherein the bit plane BP is angled in opposite directions with respect to a bit plane BP that is parallel to the rotational axis RA (shown dotted).

FIG. 6*a* shows a negative angle $\alpha$, wherein the part of the arm 30 closest to the hub 20 is tilted backwards, i.e. in a direction opposite to the direction in which the bits 40 are directed and the part of the arm 30 closest to the base ring 10 is tilted forwards, i.e. in the direction in which the bits 40 are directed.

FIG. 6*b* shows a positive angle $\alpha$, wherein the part of the arm 30 closest to the hub 20 is tilted forwards and the part of the arm 30 closest to the base ring 10 is tilted backwards.

Angle $\alpha$ is preferably in the range $-5°<\alpha<20°$ or more preferably in the range $5°<\alpha<15°$.

Figure 7:
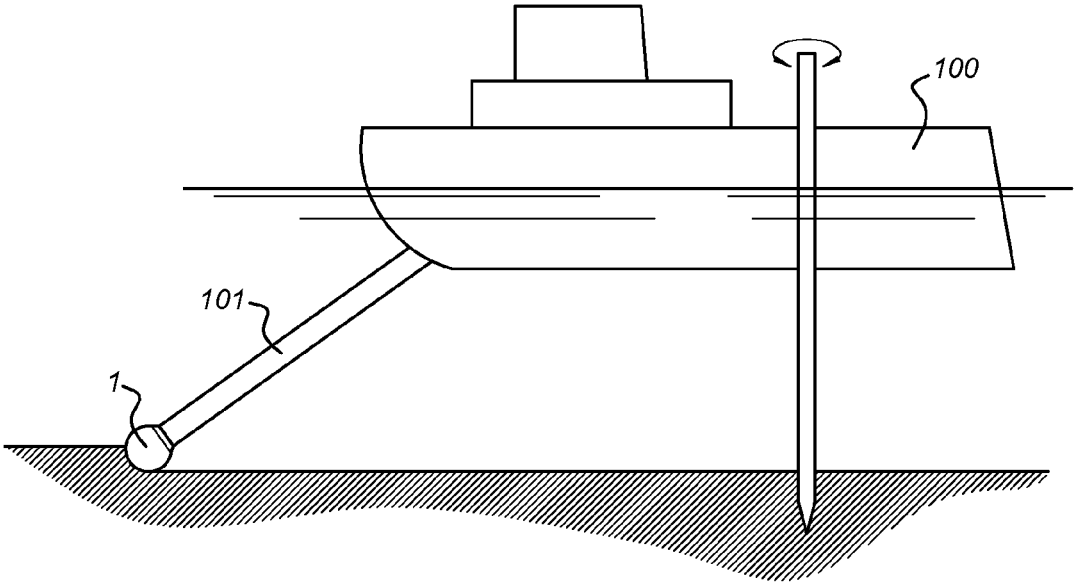

FIG. 7 schematically depicts a vessel 100, such as a cutter-suction dredger comprising a suction tube 101 to which a cutter head 1 as described above is attached. The vessel further comprises a spud.

Based on the above it is clear that there is thus provided a cutter head 1 for removing material from a water bed, the cutter head 1 being arranged to rotate about an axis of rotation RA, the cutter head 1 comprising a base ring 10 and a hub 20, the base ring 10 and the hub 20 being positioned rotational symmetric with respect to the axis of rotation RA, the cutter head 1 comprising a plurality of arms 30 extending between the base ring 10 and the hub 20, the arms 30 comprising a plurality of excavating tools 40, wherein the excavating tools are provided by bits 40 having rotational symmetric bit ends 41, wherein the bit ends 41 associated with an arm define a bit plane BP. The bit plane BP may be parallel and offset to the rotational axis RA or may be at an angle alpha with respect to the rotational axis RA.

Also provided is a cutter head 1 for removing material from a water bed, the cutter head 1 being arranged to rotate about an axis of rotation RA, the cutter head 1 comprising a base ring 10 and a hub 20, the base ring 10 and the hub 20 being positioned rotational symmetric with respect to the axis of rotation RA, the cutter head 1 comprising a plurality of arms 30 extending between the base ring 10 and the hub 20, the arms 30 comprising a plurality of excavating tools 40, wherein the excavating tools are provided by bits 40 having rotational symmetric bit ends 41, wherein the groups of adjacent bits form a rake.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A cutter head for removing material from a water bed, the cutter head being arranged to rotate about an axis of rotation, the cutter head comprising a base ring and a hub, the base ring and the hub being positioned rotational symmetric with respect to the axis of rotation, the cutter head comprising a plurality of arms extending between the base ring and the hub, the arms comprising a plurality of excavating tools, wherein the excavating tools are provided by bits having rotational symmetric bit ends, wherein the arms comprise two or more groups of bits, each group comprising three or more adjacent bits of which the bit ends define a straight line segment, wherein the base ring and the hub are axially displaced with respect to each other along the axis of rotation, the hub being positioned closer to a distal end of the cutter head with respect to the base ring, wherein the base ring has a first diameter and the hub has a second diameter, the first diameter being larger than the second diameter, and the arms converge towards the rotational axis in a direction from the base ring to the hub, wherein angles between the respective straight line segments and the axis of rotation increase towards the distal end of the cutter head.

2. The cutter head of claim 1, wherein the two or more line segments associated with an arm defines a bit plane.

3. The cutter head of claim 1, wherein the two or more line segments associated with an arm together form a straight bit line when projected on a projection plane perpendicular to the rotational axis.

4. The cutter head of claim 3, wherein the bit line is offset with respect to the rotational axis.

5. The cutter head of claim 3, wherein the bit line crosses the rotational axis.

6. The cutter head of claim 1, wherein the line segments are angled with respect to each other in a direction towards the rotational axis in a direction from the base ring to the hub.

7. The cutter head of claim 2, wherein the bit plane is parallel to and offset with respect to the rotational axis.

8. The cutter head of claim 2, wherein the bit plane and the rotational axis cross at an angle $\alpha$, wherein $5° < \alpha < 20°$.

9. The cutter head of claim 1, wherein the arms comprise straight elongated bit holders, each bit holder being arranged to hold a plurality of bits.

10. The cutter head of claim 1, wherein the cutter head comprises a plurality of sub-arms and an intermediate ring positioned in between the base ring and the hub, the sub-arms comprising a plurality of excavating tools, and wherein the sub-arms extend between the base ring and the intermediate ring and are shorter than the arms extending between the base ring and the hub.

11. The cutter head of claim 1, wherein the plurality of arms comprise at least 8 bits per meter.

12. The cutter head of claim 1, wherein the arms comprise fifteen bits or more.

13. The cutter head of claim 1, wherein the bits are rotatable about their body axes.

14. A vessel comprising the cutter head according to claim 1.

15. The vessel according to claim 14, wherein the vessel is a cutter-suction dredger.

* * * * *